US009713830B2

(12) United States Patent
Yamamoto

(10) Patent No.: US 9,713,830 B2
(45) Date of Patent: Jul. 25, 2017

(54) DIRECT DOUBLE-ACTION EXTRUSION PRESS

(71) Applicant: Ube Machinery Corporation, Ltd., Ube (JP)

(72) Inventor: Takeharu Yamamoto, Ube (JP)

(73) Assignee: Ube Machinery Corporation, Ltd. (JP)

( * ) Notice: Subject to any disclaimer, the term of this patent is extended or adjusted under 35 U.S.C. 154(b) by 0 days.

(21) Appl. No.: 15/101,041

(22) PCT Filed: Nov. 18, 2014

(86) PCT No.: PCT/JP2014/080491
§ 371 (c)(1),
(2) Date: Jun. 2, 2016

(87) PCT Pub. No.: WO2015/083536
PCT Pub. Date: Jun. 11, 2015

(65) Prior Publication Data

US 2016/0303629 A1 Oct. 20, 2016

(30) Foreign Application Priority Data

Dec. 4, 2013 (JP) ..... 2013-250675
Dec. 10, 2013 (JP) ..... 2013-254934

(51) Int. Cl.
*B21C 23/21* (2006.01)
*B21C 23/08* (2006.01)
*B21C 31/00* (2006.01)

(52) U.S. Cl.
CPC ..... *B21C 23/217* (2013.01); *B21C 23/08* (2013.01); *B21C 31/00* (2013.01)

(58) Field of Classification Search
CPC ..... B21C 23/085; B21C 23/21; B21C 23/211; B21C 23/217; B21C 23/218
See application file for complete search history.

(56) References Cited

U.S. PATENT DOCUMENTS 2,896,783 A 7/1959 Swanson
3,180,124 A 4/1965 Robra
(Continued)

FOREIGN PATENT DOCUMENTS

GB 837126 A 6/1960
JP 49-26188 B 7/1974
(Continued)

*Primary Examiner* — Debra Sullivan
(74) *Attorney, Agent, or Firm* — DLA Piper LLP (US)

(57) ABSTRACT

A direct double-action extrusion press includes a main crosshead to which an extrusion stem is fixed; a main cylinder having a main ram that advances the main crosshead and pressing on a billet; a piercer cylinder disposed inside the main ram and drives a mandrel; a plurality of side cylinders that retracts the main ram via the main crosshead; and a hydraulic circuit for supplying hydraulic oil to the main cylinder, the piercer cylinder, and the side cylinders. Cylinder chambers of the plurality of side cylinders on a side where the hydraulic oil is discharged when the main crosshead is advancing have a pressure-receiving area equal in total to that of a rod side chamber of the piercer cylinder. During billet extrusion, the hydraulic circuit causes fluid communication through the rod side chamber of the piercer cylinder and each cylinder chamber of the plurality of side cylinders on the side where the hydraulic oil is discharged.

4 Claims, 3 Drawing Sheets

(56) References Cited

U.S. PATENT DOCUMENTS

| | | | | | |
|---|---|---|---|---|---|
| 3,350,911 | A | | 11/1967 | Groos | |
| 3,709,013 | A | | 1/1973 | Petsch | |
| 4,050,281 | A | * | 9/1977 | Sibler | B21C 23/217 72/265 |
| 4,206,626 | A | * | 6/1980 | Groos | B21C 23/21 72/253.1 |
| 4,230,661 | A | | 10/1980 | Asari et al. | |
| 2015/0202672 | A1 | | 7/2015 | Moroi et al. | |

FOREIGN PATENT DOCUMENTS

| | | | |
|---|---|---|---|
| JP | 51-42059 | A | 4/1976 |
| JP | 54-56967 | A | 5/1979 |
| JP | 58-185309 | U | 12/1983 |
| JP | 61-147916 | A | 7/1986 |
| WO | 2014/041881 | A1 | 3/2014 |

* cited by examiner

DIRECT DOUBLE-ACTION EXTRUSION PRESS

TECHNICAL FIELD

The present invention relates to a direct double-action extrusion press for extruding a tubular product.

BACKGROUND ART

Known in the past, for example, has been an extrusion press using copper, aluminum, an alloy thereof, etc. to extrude a tubular product by a direct double-action extrusion process. The extrusion press comprises a cylinder platen and an end platen arranged facing each other. The cylinder platen is provided with a main cylinder, main ram, extrusion stem, and mandrel, while the end platen is provided with a die. Between the extrusion stem and die, there is a container which can be made to freely advance and retract by container cylinders.

The extrusion stem has a dummy block arranged at its front end. The extrusion stem is attached to the main ram assembled in the main cylinder provided at the cylinder platen through the main cross-head. At the center position of the extrusion stem, the mandrel is arranged together with a piercer cylinder rod to be able to accompany and advance and retract with the extrusion stem. Further, the die is attached to the end platen facing the extrusion stem.

Between the extrusion stem and the die, the container is arranged to be able to advance and retract, in which a billet is held. The extrusion stem moves the billet stored in the container to the die side to thereby push the billet and complete the upset operation. After the upset operation, the mandrel advances to pierce the billet. The mandrel stops at a predetermined advancing position of the die. The extrusion stem is then again advanced to extrude the billet as a tubular product.

In this double-action extrusion press, when making the front end part of the mandrel stop at a predetermined position of a bearing part of the die and then extruding the product, the position of the mandrel is held so that its stopping position does not shift even if the relative positions of the mandrel and the bearing part of the die changes by a pulling action by the product.

PLT 1 discloses a double-action extrusion press which is provided with a piercer cylinder provided inside a main cylinder and a trigger forcibly connected with the mandrel away from the axial center of the extrusion press. This trigger acts on a hydraulic pilot valve to hold a bearing part of a die at a predetermined axial direction position (stopping position). For this, a certain amount of the pressurized fluid medium starts to be supplied to a rod side chamber of the piercer cylinder. Further, the position holding operation is controlled so that the amount of the pressurized fluid medium supplied matches the amount of increase of volume of the piercer cylinder rod side chamber when the mandrel is stationary and the main ram advances.

In this regard, in this conventional double-action extrusion press, the hydraulic pilot valve is switched mechanically through the trigger and a connecting rod to supply a certain amount of pressurized fluid medium to thereby hold the mandrel at a predetermined position of the bearing part of the die, so a delay occurs in control by exactly the amount of the stroke of movement corresponding to a land of a spool of the hydraulic pilot valve and a front end part of the mandrel moves back and forth by several millimeters with respect to the predetermined stopping position during an extrusion operation.

Furthermore, when changing the front end position of the mandrel or changing the extrusion speed, it is necessary to adjust the position of the trigger and the amount of fluid and pressure supplied to the rod side chamber of the piercer cylinder so as to adjust the pressure each time.

For this reason, the wall thickness of the extruded tubular products fluctuates and a stable quality of tubular products cannot be obtained.

Furthermore, in a conventional double-action extrusion press, there is the following problem: After pushing the billet in the container by the extrusion stem, then upsetting the billet and piercing the inside of the billet by a mandrel, then extruding it by a fixed mandrel, a frictional force occurs between the surfaces of the billet and mandrel and a pull force acts on the mandrel during extrusion. Due to this, the extrusion force acting on the die decreases by that amount, so it is not possible for the extrusion force to be effectively utilized at the start when the extrusion force is most required.

CITATION LIST

Patent Literature

PLT 1: Japanese Patent Publication No. 49-26188B

SUMMARY OF INVENTION

Technical Problem

The present invention is made so as to solve the above problem and has as its object the provision of a direct double-action extrusion press for obtaining a tubular product provided with a mandrel holding means for holding a mandrel at a predetermined stopping position at a bearing part of a die without moving forward or back so as to keep the front end position of the mandrel from fluctuating during extrusion.

Solution to Problem

The present invention provides a direct double-action extrusion press comprising an extrusion stem, a main cross-head to which the extrusion stem is fastened, a main cylinder having a main ram which makes the main cross-head and therefore the extrusion stem advance in an extrusion direction for extruding a billet, a piercer cylinder arranged in the main ram, which piercer cylinder making a piercing use mandrel advance and retract passing through the extrusion stem and the main cross-head and holding the mandrel at a predetermined position, a plurality of side cylinders making the main ram retract through the main cross-head, and a hydraulic circuit supplying a hydraulic fluid to the main cylinder, the piercer cylinder, and the plurality of side cylinders, wherein a plurality of cylinder chambers of the plurality of side cylinders at the sides discharging the hydraulic fluid when the main cross-head advances have in total a pressure receiving area equal to a rod side chamber of the piercer cylinder, and the hydraulic circuit fluidly communicates the plurality of cylinder chambers at the sides discharging the hydraulic fluid of the plurality of side cylinders and the rod side chamber of the piercer cylinder during extrusion of the billet.

In the present invention, the hydraulic circuit may comprise a variable discharge hydraulic pump adjusting an amount of fluid of the piercer cylinder.

In the present invention, not only the main ram, but also the plurality of side cylinders can make the main cross-head and therefore the extrusion stem advance in the extrusion direction.

In the present invention, the hydraulic circuit may comprise a pressure sensor for sensing an fluid pressure acting on a rod side of the piercer cylinder during extrusion of the billet and may control the fluid pressure acting in the extrusion direction of the plurality of side cylinders in accordance with the detected fluid pressure acting on the rod side of the piercer cylinder.

Advantageous Effects of Invention

The cylinder chamber pressure receiving area at the sides where the side cylinders discharge hydraulic fluid when the main cross-head moves in the extrusion direction and the rod side chamber pressure receiving area of the piercer cylinder are made substantially the same, and the hydraulic fluid discharged from the side cylinders synchronized with the extrusion stem during extrusion is supplied through a hydraulic pipeline to the rod side chamber of the piercer cylinder, so it is possible to hold the front end position of the mandrel at a predetermined certain position during extrusion, the operation of holding the position of the mandrel can be easily controlled, the position precision can be improved, and the extruded product becomes stable in quality.

Even if changing the extrusion speed during an extrusion operation, there is no need to adjust the pressure or amount of the hydraulic fluid supplied to the rod side chamber of the piercer cylinder and the operability is improved.

When the main cross-head moves in the extrusion direction, the cylinder chambers at the sides discharging the hydraulic fluid and the rod side chamber of the piercer cylinder are supplied with pressurized fluid by a pressurized fluid feeding means, so the amounts of leakage and pressure drops of the two cylinders are compensated for and control of the holding position of the mandrel is improved.

The direct double-action extrusion press of the present invention supplements the extrusion force decreased by the frictional force acting during extrusion between the surfaces of the billet and the mandrel by supplying pressurized fluid set to a specific pressure to the main ram and side cylinders to thereby make the fluid pressure act on side cylinders having a hydraulic type mandrel stopper function in the extrusion direction and increase the force. Due to this, it becomes possible to extrude thin-wall tubular products which could not be extruded in the past and long size billets, the double-action extrusion press can be made smaller in size, and improved productivity, energy saving, and labor saving can be achieved. Further, even if the extrusion force changes during the extrusion operation, there is no need to adjust the pressure or amount of the hydraulic fluid supplied to the container cylinders and the operability is improved.

DESCRIPTION OF EMBODIMENTS

Below, a direct double-action extrusion press 10 according to a first embodiment of the present invention will be explained with reference to FIG. 1.

Figure 1:
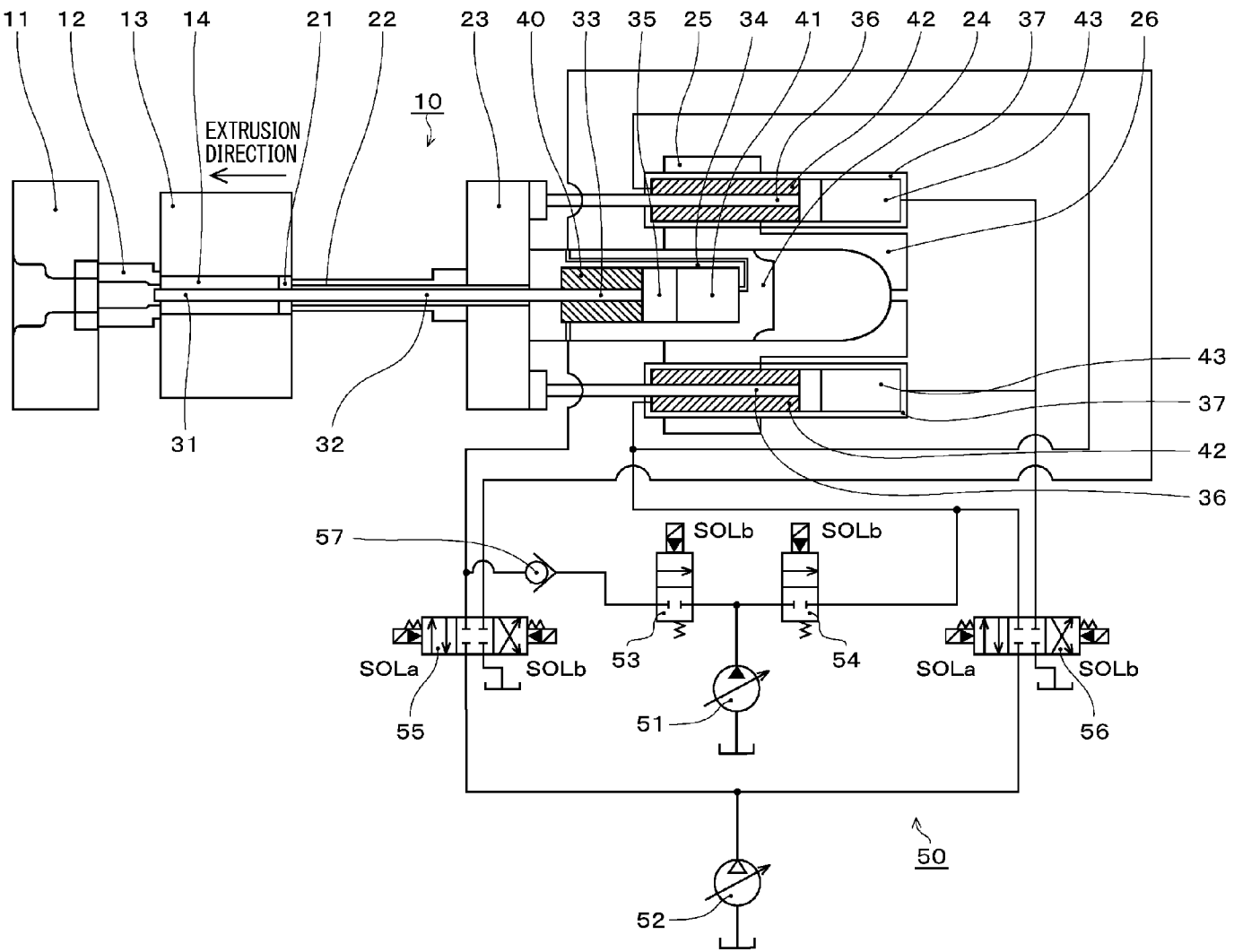
FIG. 1 is a cross-sectional view showing a direct double-action extrusion press of a first embodiment of the present invention in brief.

As shown in FIG. 1, the extrusion press 10 comprises an end platen 11 and a cylinder platen 25 arranged facing each other. The end platen 11 is provided with a die 12, while the cylinder platen 25 is provided with a main cylinder 26, main ram 24, main cross-head 23, and extrusion stem 22. Between the end platen 11 and the cylinder platen 25, there is a container 13 able to be advanced and retract by not shown container cylinders arranged at the end platen 11.

The extrusion stem 22 is attached through the main cross-head 23 to the main ram 24 assembled in the main cylinder 26 provided at the cylinder platen 25. At the center position of the extrusion stem 22, a mandrel 31 is attached through a sub mandrel 32 and piercer cylinder rod 33 to a piercer cylinder piston 35 and is arranged to be able to accompany the extrusion stem 22 and advance and retract. The die 12 is provided at the end platen 11 facing the extrusion stem 22.

A billet 14 is supplied between the die 12 and the container 13 moved to the cylinder platen 25 side together with a dummy block 21 by a not shown billet loader. For smoothing the supply of the billet 14, it is also possible to insert only the billet 14 in the container 13, then retract the extrusion stem and use a not shown dummy block supply device to move the dummy block 21 to the center of the extrusion press and insert it into the container 13.

The cylinder platen 25 has two side cylinders 37 attached to it. Side cylinder rods 36 are fastened to the main cross-head 23. The side cylinders 37 in the present embodiment, as will be understood from the hydraulic circuit of FIG. 1, not only make the advanced main cross-head 23 and main ram 24 retract, but also act to push the main cross-head 23 and make it advance. In this figure, there are two side cylinders 37, but there may also be four.

Further, inside the main ram 24, there is a piercer cylinder 34. The sub mandrel 32 coupled with the piercer cylinder rod 33 is arranged to be able to advance and retract inside of the extrusion stem 22 and main cross-head 23.

Next, the direct double-action extrusion press 10 according to the first embodiment according to the present invention will be explained in more detail using FIG. 1. In FIG. 1, reference numeral 11 indicates the end platen, reference numeral 25 indicates the cylinder platen provided facing the end platen, reference numeral 24 indicates the main ram attached to the main cylinder 26 to be able to slide and pushing the extrusion stem 22 through the main cross-head 23, and reference numeral 23 denotes the main cross-head coupled with the main ram 24. The main cross-head 23 is arranged so as to slide on a not shown machine base. Note that, the end platen 11 and the cylinder platen 25 are configured to be able to be held by the same not shown tie-bars at a predetermined interval.

Further, inside the main ram 24, the piercer cylinder 34 is provided. At the front end of the piercer cylinder rod 33, the mandrel 31 is screwed through the sub mandrel 32. Further, the mandrel 31 is inserted to be able to slide inside the extrusion stem 22 attached to the front end of the main cross-head 23.

On the other hand, the end platen 11 is provided with the die 12. The container 13 is arranged to be able to advance and retract by a plurality of container cylinders provided at the end platen 11. Reference numeral 21 denotes the dummy block arranged at the front end of the extrusion stem 22.

In FIG. 1, reference numeral 40 shows a rod side chamber of the piercer cylinder 34. The pressure receiving area is set to "A" cubic centimeters. Reference numeral 42 shows the cylinder chambers of the side cylinders 37 at the sides where the hydraulic fluid is discharged when the main cross-head 23 moves in the extrusion direction. In FIG. 1, two side cylinders 37 are provided, so the pressure receiving areas of the side cylinders, which become substantially the same, are set to one half of the pressure receiving area "A" cubic centimeter (½ A cubic centimeter) of the rod side chamber of the piercer cylinder 34. In FIG. 1, the side cylinders 37 are provided at the cylinder platen 25, so the discharge sides of the hydraulic fluid when the main cross-head 23 moves forward in the extrusion direction become the rod side of the cylinders. When configured using four side cylinders 37, the pressure receiving area is set to one-quarter of "A" cubic centimeters (¼ A cubic centimeter).

Figure 2:
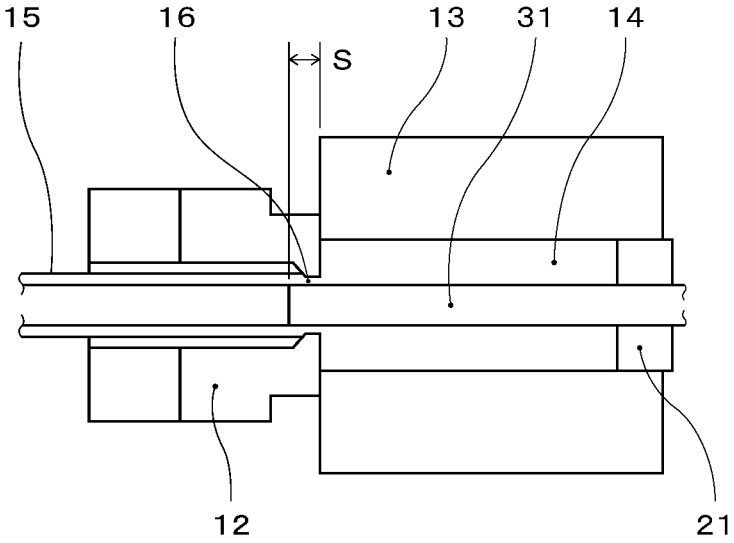
FIG. 2 is an explanatory view showing the state of extrusion where the front end of the mandrel is positioned at the bearing part of the die.

The mandrel holding means is configured to be communicated with the sides where the hydraulic fluid is discharged when the rod side chamber 40 of the piercer cylinder 34 and the side cylinders 37 advance when extruding the billet 14, that is, the rod side chambers 42 of the side cylinders in FIG. 1. In the direct double acting extrusion type of extrusion press, the mandrel 31 and the main cross-head 23 synchronously move forward (accompany each other), so the hydraulic fluid discharged from the side cylinders 37 due to the communication is supplied to the rod side chamber of the piercer cylinder 34. For this reason, even if the extrusion stem 22 moves forward, the front end of the mandrel 31 moves relatively without actually moving. As shown in FIG. 2, the front end of the mandrel 31 holds a predetermined stopping position S from the end face of the die 12. The front end position of the mandrel 31 is restricted.

In FIG. 2, reference numeral 15 shows a tubular extruded product extruded from the die 12, while 16 shows a bearing part of the die.

Referring to FIG. 1, the configuration of the hydraulic circuit 50 of the mandrel holding means of the direct double-action extrusion press 10 according to the first embodiment will be explained. Reference numerals 51 and 52 denote variable discharge hydraulic pumps driven by not shown motors. The variable discharge hydraulic pumps 51 and 52 are provided with not shown known pressure regulators etc., are adjusted in pressure, and supply pressurized fluid to the cylinders. Reference numeral 55 denotes a solenoid valve operating the piercer cylinder 34, while 56 is a solenoid valve operating the side cylinders 37. Reference numerals 53 and 54 and numeral 57 denote solenoid valves and a check valve which operate when communicated with the rod side chambers 42 of the side cylinders at the sides where hydraulic fluid is discharged when the rod side chamber 40 of the piercer cylinder 34 and the side cylinders 37 advance.

The operation of the direct double-action extrusion press 10 according to the first embodiment configured as explained above will be explained. The billet 14 is placed together with a dummy block 21 on a billet loader and supplied to a center position of extrusion. Next, the main ram 24 is made to advance to make the front end of the extrusion stem 22 contact the end face of the dummy block 21, load the billet 14 in the billet insertion hole, and then perform an upset operation. After the upset operation, an SOLb of the solenoid valve 55 is magnetized to introduce pressurized fluid to the piston head side chamber of the piercer cylinder 34, the mandrel 31 is made to advance while piercing the billet 14, and the front end of the mandrel 31 is made to stop at a predetermined position (S) of the bearing part 16 of the die 12 shown in FIG. 2. The SOLb of the solenoid valve 55 is demagnetized by holding that position.

The predetermined stopping position holding operation of the mandrel 31 shown in FIG. 2 may comprise (measuring and determining the relative positions of mandrel 31 and die 12 in advance) attaching a scale sensor (not shown) in advance to the piercer cylinder rod 33 of the piercer cylinder 34 or main cross-head 23 and determining the relative positions of the piercer cylinder rod 33 and the piercer cylinder 34, but the invention is not limited to this so long as the front end of the mandrel 31 is set to the predetermined stopping position of the bearing part 16 of the die 12. Another method may also be used to determine the relative positions.

Next, the main ram 24 is made to again advance to make the extrusion stem 22 move and obtain the desired tubular extruded product 15 having a uniform wall thickness from the die 12. During extrusion, the SOLb of the solenoid valve 56 is magnetized to synchronize the side cylinders 37 with the speed of advance of the mandrel 31. Further, the SOLb's of the solenoid valves 53 and 54 are magnetized to communicate the rod side chambers 42 of the side cylinders 37 and the rod side chamber 40 of the piercer cylinder 34. As explained above, the rod side chamber pressure receiving area of the side cylinders 37 and the rod side chamber pressure receiving area of the piercer cylinder 34 are made substantially the same areas, so the hydraulic fluid discharged from the side cylinders 37 causes the piercer cylinder rod 33 to move relatively synchronously with the advancing speed of the main cross-head 23. For this reason, the front end face of the mandrel 31 at a predetermined stopping position of the bearing part 16 of the die 12 is constantly held at that predetermined stopping position. In the positional control for synchronization with the movement of positions of the mandrel 31 and extrusion stem 22, the leakage from the piercer cylinder 34 and two side cylinders 37 and deviation due to pressure, volumetric efficiency, etc. are corrected by using the variable discharge hydraulic pump 51 to supply pressurized fluid to the two cylinder chambers.

At the time of the end of the extrusion, the magnetized SOLb's of the solenoid valves are demagnetized.

After the end of the extrusion, if the pressurized fluid pushing the main ram 24 to the advancing side is lowered in pressure and discharged and pressurized fluid is introduced to the rod sides of the side cylinders 37 to make the main ram 24 pull back and make the main cross-head 23 retract, the extrusion stem 22 retracts. Next, pressurized fluid is supplied to the rod side chamber 40 of the piercer cylinder 34 to make the mandrel 31 retract and pull out of the nonextruded part of the billet 14. After this, the discard part is cut off from the die 12.

The cylinder chamber pressure receiving area at the side where the side cylinders discharge hydraulic fluid when the main cross-head moves in the extrusion direction and the rod side chamber pressure receiving area of the piercer cylinder are made substantially the same and the hydraulic fluid discharged from the side cylinders synchronously with the extrusion stem during extrusion is supplied through the hydraulic pipeline to the rod side chamber of the piercer cylinder, so it is possible to hold the front end position of the mandrel during extrusion at a predetermined certain position, the operation of holding the position of the mandrel can be easily controlled, the position precision can be improved, and the extruded product becomes stable in quality.

Even if changing the extrusion speed during the extrusion operation, there is no need to adjust the pressure or supply of the hydraulic fluid supplied to the rod side chamber of the piercer cylinder each time and the operability is improved.

When the main cross-head moves in the extrusion direction, the cylinder chambers at the sides discharging the hydraulic fluid and the rod side chamber of the piercer cylinder are supplied with pressurized fluid from the pressurized fluid feeding means, so the leakage of the two cylinders and the drop in pressure are compensated for and the control of the holding position of the mandrel is improved.

Figure 3:
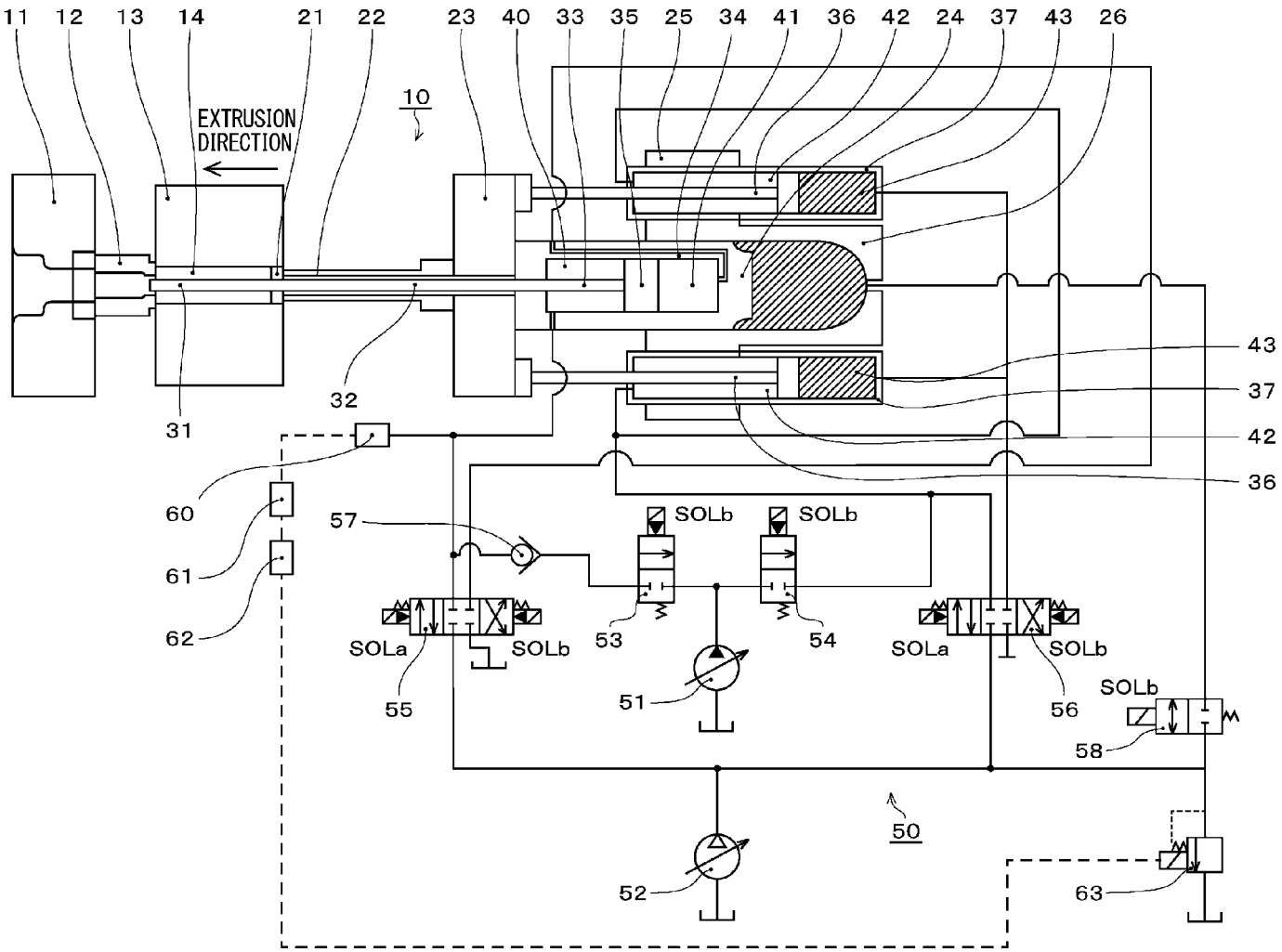
FIG. 3 is a cross-sectional view showing a direct double-action extrusion press of a second embodiment of the present invention in brief.

Next, the direct double-action extrusion press according to the second embodiment of the present invention will be explained below with reference to FIG. 3. The direct double-action extrusion press according to the second embodiment is similar in configuration of the extrusion press body with the press according to the first embodiment. The configuration of the part related to the hydraulic circuit differs. Therefore, here, the explanation of the configuration of the extrusion press body will be omitted. Further, the reference numerals of the components are the same as those according to the first embodiment other than for the newly added components.

The configuration of a hydraulic circuit 50 of a mandrel holding means of the direct double-action extrusion press 10 according to the second embodiment will be explained. Reference numerals 51 and 52 denote variable discharge hydraulic pumps which are driven by not shown motors. The variable discharge hydraulic pumps 51 and 52 are provided with proportional electromagnetic relief valves of reference numerals 63, the pressure is adjusted, and the cylinders are supplied with pressurized fluid. Reference numeral 55 denotes a solenoid valve for operating the piercer cylinder 34, reference numeral 56 denotes a solenoid valve for operating the side cylinders 37, while reference numerals 53 and 54 and numeral 57 denote solenoid valves and a check valve which operate when communicated with the rod side chambers 42 of the side cylinders at the side where hydraulic fluid is discharged when the rod side chamber 40 of the piercer cylinder 34 and the side cylinders 37 advance.

In the double-action extrusion press 10 according to the second embodiment, at the same time as starting the extrusion, the SOLb's of the solenoid valve 56 and solenoid valve 58 are magnetized and pressurized fluid is sent from the variable discharge pump 52 to the main ram 24 and the side cylinders 24 at the head sides. Due to this pressurized fluid, the side cylinder rods 36 push the main cross-head 23 and the extrusion force of the extrusion stem 22 is increased.

Note that this pressurized fluid increases the extrusion force by changing the pressure setting enough to make up for the amount of loss of the extrusion force of the mandrel pull force by the proportional electromagnetic relief valves 63.

The operation of the direct double-action extrusion press 10 according to the second embodiment configured as explained above will be explained. First, the container 13 is made to move to the die 12 and the billet 14 is placed together with the dummy block 21 on the billet loader and supplied to the extrusion center position. Next, the main ram 24 is made to advance to bring the front end of the extrusion stem 22 into contact with the end face of the dummy block 21, load the billet 14 in the billet insertion hole, and then perform an upset operation. After the upset operation, the SOLb of the solenoid valve 55 is excited to introduce pressurized fluid into the piston head side chamber of the piercer cylinder 34, make the mandrel 31 advance while piercing the billet 14, and make the front end of the mandrel 31 stop (S) at a predetermined position of the bearing part 16 of the die 12 shown in FIG. 2. The SOLb of the solenoid valve 55 is demagnetized by holding that position.

Here, the frictional force acting on the mandrel 31 of the extrusion press 10 according to the second embodiment will be explained. The frictional force acting between the billet 14 and the mandrel 31 during extrusion acts on the billet 14 in a direction opposite to the extrusion direction. The frictional force corresponds to the value obtained by multiplying the pressure acting on the piercer cylinder rod chamber 40 by the rod side area A. The control means for enabling the extrusion force to make up for the amount of loss due to the frictional force explained above will be shown next.

The method of control of the side cylinders 37 for increasing the extrusion force by the fluid pressure of the side cylinders 37 in addition to the fluid pressure of the main ram 24 explained above will be explained with reference to FIG. 3.

The frictional force acting on the mandrel 31 is propagated as load and acts on the rod side cylinder chamber 40 of the piercer cylinder 34. Therefore, the fluid pressure of the rod side cylinder chamber 40 of the piercer cylinder 34 (side cylinder rod chambers 42 also ok) is detected by the pressure sensor 60, the obtained signal is amplified by the amplifier 61 and converted to pressure by the controller 62, then the pressure of the proportional electromagnetic relief valves 63 is controlled. The pressurized fluid sent from the variable discharge hydraulic pump 52 is sent to the head sides 43 of the side cylinders 37 by a pressure value of the pressure setting of the proportional electromagnetic relief valves 63. Due to this pressurized fluid, it is possible to increase the extrusion force.

Here, the pressure setting is set by multiplying the ratio of the piercer cylinder rod side area and total area of the main ram 24 and side cylinder head sides by the detection pressure of the piercer cylinder rod chamber 40.

As explained above, the direct double-action extrusion press according to the second embodiment supplements the extrusion force decreased by the frictional force acting during extrusion between the billet and mandrel surface by supplying pressurized fluid set in pressure to the main ram and side cylinders to thereby make the fluid pressure act on side cylinders having a hydraulic type mandrel stopper function in the extrusion direction and increase the force. Due to this, it becomes possible to extrude thin-wall tubular products which could not be extruded in the past and long size billets, the double-action extrusion press can be made smaller in size, and improved productivity, energy saving, and labor saving can be achieved. Further, even if the extrusion force fluctuates during the extrusion operation, there is no longer a need to adjust the pressure or supply of hydraulic fluid supplied to the side cylinders each time and the operability can be improved.

Note that, the extrusion press of the present invention can be applied to not only a conventional (not short stroke type) direct double-action extrusion press, but also a front loading type short stroke direct double-action extrusion press which inserts a billet between the die and extrusion stem.

Note that, the present invention is explained in detail based on specific embodiments, but a person skilled in the art could make various changes, corrections, etc. without departing from the claims and concepts of the present invention.

REFERENCE SIGNS LIST

11. end platen
12. die
13. container
14. billet
15. extruded product
16. bearing part
21. dummy block
22. extrusion stem
23. main cross-head
24. main ram
25. cylinder platen
26. main cylinder
31. mandrel
32. sub mandrel
33. piercer cylinder rod
34. piercer cylinder
36. side cylinder rod
37. side cylinder
40. piercer cylinder rod chamber
41. piercer cylinder head chamber
42. side cylinder rod chamber
43. side cylinder head chamber
51, 52. variable discharge hydraulic pump
53 to 56. solenoid valves
57. check valve
58. solenoid valve
60. pressure sensor
61. amplifier
62. controller
63. proportional electromagnetic relief valve

The invention claimed is:

1. A direct double-action extrusion press comprising:

an extrusion stem;

a main cross-head fastened to said extrusion stem;

a main cylinder having a main ram that causes said main cross-head and, therefore, said extrusion stem to advance in an extrusion direction to extrude a billet;

a piercer cylinder arranged in said main ram that causes a piercing use mandrel to advance and retract passing through said extrusion stem and said main cross-head and holding the mandrel at a predetermined position;

a plurality of side cylinders that cause said main ram to retract through said main cross-head; and a hydraulic circuit supplying hydraulic fluid to said main cylinder, said piercer cylinder, and said plurality of side cylinders;

wherein a plurality of cylinder chambers of said plurality of side cylinders at sides discharging the hydraulic fluid when said main cross-head advances have in total a pressure receiving area equal to a rod side chamber of said piercer cylinder, and said hydraulic circuit fluidly communicates with said plurality of cylinder chambers at the sides discharging the hydraulic fluid of said plurality of side cylinders and the rod side chamber of said piercer cylinder during extrusion of said billet.

2. The direct double-action extrusion press according to claim 1, wherein said hydraulic circuit comprises a variable discharge hydraulic pump adjusting an amount of fluid of said piercer cylinder.

3. The direct double-action extrusion press according to claim 1, wherein not only said main ram, but also said plurality of side cylinders cause said main cross-head and, therefore, said extrusion stem to advance in the extrusion direction.

4. The direct double-action extrusion press according to claim 3, wherein said hydraulic circuit comprises a pressure sensor that senses a fluid pressure acting on a rod side of said piercer cylinder during extrusion of said billet and controls the fluid pressure acting in the extrusion direction of said plurality of side cylinders in accordance with the detected fluid pressure acting on the rod side of said piercer cylinder.

* * * * *